US011383516B2

(12) United States Patent
Martin et al.

(10) Patent No.: US 11,383,516 B2
(45) Date of Patent: Jul. 12, 2022

(54) FLUIDIC DIES WITH TRANSMISSION PATHS HAVING CORRESPONDING PARASITIC CAPACITANCES

(71) Applicant: Hewlett-Packard Development Company, L.P., Spring, TX (US)

(72) Inventors: Eric T. Martin, Corvallis, OR (US); Vincent C. Korthuis, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/972,119

(22) PCT Filed: Nov. 21, 2018

(86) PCT No.: PCT/US2018/062239

§ 371 (c)(1),
(2) Date: Dec. 4, 2020

(87) PCT Pub. No.: WO2020/106288

PCT Pub. Date: May 28, 2020

(65) Prior Publication Data

US 2021/0268797 A1 Sep. 2, 2021

(51) Int. Cl.

| | |
|---|---|
| ***B41J 2/14*** | (2006.01) |
| ***B41J 2/045*** | (2006.01) |
| *B41J 2/155* | (2006.01) |

(52) U.S. Cl.

CPC ..... *B41J 2/14153* (2013.01); *B41J 2/0458* (2013.01); *B41J 2/14072* (2013.01); *B41J 2/155* (2013.01)

(58) Field of Classification Search

CPC .. B41J 2/14153; B41J 2/0458; B41J 2/14072; B41J 2/155

See application file for complete search history.

(56) References Cited

U.S. PATENT DOCUMENTS 8,015,540 B2 9/2011 Taravade et al.
9,724,914 B2 * 8/2017 Fujisawa ..... B41J 2/04581
(Continued)

FOREIGN PATENT DOCUMENTS

CN 101360613 A 2/2009
CN 105873765 A 8/2016
(Continued)

*Primary Examiner* — Geoffrey S Mruk
(74) *Attorney, Agent, or Firm* — Fabian VanCott

(57) ABSTRACT

In one example in accordance with the present disclosure, a fluidic die is described. The fluidic die includes an array of firing subassemblies grouped into zones. Each firing subassembly includes 1) a firing chamber, 2) a fluid actuator disposed, and 3) a sensor plate. The fluidic die also includes a measurement device per zone to determine a state of a selected sensor plate. The fluidic die includes a selector per firing subassembly to couple the selected sensor plate to the measurement device. The fluidic die also includes a transmission path between each selector and its corresponding sensor plate. A first transmission path for a particular sensor plate has physical properties such that a parasitic capacitance along the first transmission path corresponds to a parasitic capacitance for a second transmission path of a second sensor plate in the zone, regardless of a difference in transmission path length.

15 Claims, 6 Drawing Sheets

(56) References Cited

U.S. PATENT DOCUMENTS

| | | | | |
|---|---|---|---|---|
| 10,882,310 | B2 * | 1/2021 | Anderson | B41J 2/04541 |
| 2009/0284558 | A1 | 11/2009 | Cerutti | |
| 2017/0203561 | A1 | 7/2017 | Ge et al. | |

FOREIGN PATENT DOCUMENTS

| | | | |
|---|---|---|---|
| EP | 0148620 | | 7/1985 |
| EP | 0303049 | | 2/1989 |
| TW | 201532847 | A | 9/2015 |
| WO | WO-2016014087 | | 1/2016 |
| WO | WO-2016175740 | A1 | 11/2016 |
| WO | WO-2018190872 | | 10/2018 |

* cited by examiner

FLUIDIC DIES WITH TRANSMISSION PATHS HAVING CORRESPONDING PARASITIC CAPACITANCES

BACKGROUND

A fluidic die is a component of a fluidic system. The fluidic die includes components that manipulate fluid flowing through the system. For example, a fluidic ejection die, which is an example of a fluidic die, includes a number of firing subassemblies that eject fluid onto a surface. The fluidic die also includes non-ejecting actuators such as micro-recirculation pumps that move fluid through the fluidic die. Through these firing subassemblies and pumps, fluid, such as ink and fusing agent among others, is ejected or moved. Over time, these firing subassemblies and pumps can become clogged or otherwise inoperable. As a specific example, ink in a printing device can, over time, harden and crust. This can block the firing subassembly and interrupt the operation of subsequent ejection events. Other examples of issues affecting these actuators include fluid fusing on an ejecting element, particle contamination, surface puddling, and surface damage to die structures. These and other scenarios may adversely affect operations of the device in which the fluidic die is installed.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
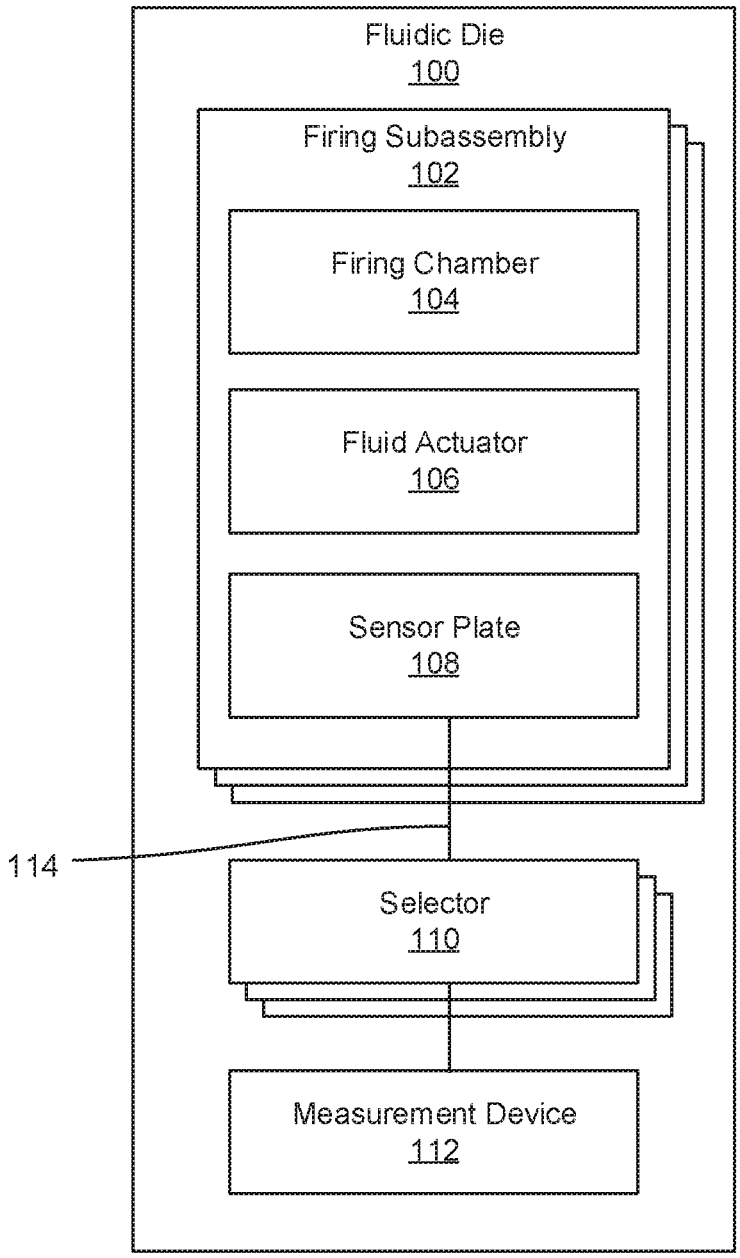
FIG. 1 is a block diagram of a fluidic die with transmission paths with corresponding parasitic capacitance, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluidic dies, as used herein, may describe a variety of types of integrated devices with which small volumes of fluid may be pumped, mixed, analyzed, ejected, etc. Such fluidic dies may include ejection dies, such as those found in printers, additive manufacturing distributor components, digital titration components, and/or other such devices with which volumes of fluid may be selectively and controllably ejected.

In a specific example, these fluidic systems are found in any number of printing devices such as inkjet printers, multi-function printers (MFPs), and additive manufacturing apparatuses. The fluidic systems in these devices are used for precisely, and rapidly, dispensing small quantities of fluid. For example, in an additive manufacturing apparatus, the fluid ejection system dispenses fusing agent. The fusing agent is deposited on a build material, which fusing agent facilitates the hardening of build material to form a three-dimensional product.

Other fluidic systems dispense ink on a two-dimensional print medium such as paper. For example, during inkjet printing, fluid is directed to a fluid ejection die. Depending on the content to be printed, the device in which the fluid ejection system is disposed determines the time and position at which the ink drops are to be released/ejected onto the print medium. In this way, the fluid ejection die releases multiple ink drops over a predefined area to produce a representation of the image content to be printed. Besides paper, other forms of print media may also be used.

Accordingly, as has been described, the systems and methods described herein may be implemented in a two-dimensional printing, i.e., depositing fluid on a substrate, and in three-dimensional printing, i.e., depositing a fusing agent or other functional agent on a material base to form a three-dimensional printed product.

Each fluidic die includes a fluid actuator to eject/move fluid. A fluid actuator may be disposed in an ejection subassembly, where the ejection subassembly includes an ejection chamber and an opening in addition to the fluid actuator. The fluid actuator in this case may be referred to as an ejector that, upon actuation, causes ejection of a fluid drop via the opening.

Fluid actuators may also be pumps. For example, some fluidic dies include microfluidic channels. A microfluidic channel is a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Fluidic actuators may be disposed within these channels which, upon activation, may generate fluid displacement in the microfluidic channel.

Examples of fluid actuators include a piezoelectric membrane based actuator, a thermal resistor based actuator, an electrostatic membrane actuator, a mechanical/impact driven membrane actuator, a magneto-strictive drive actuator, or other such elements that may cause displacement of fluid responsive to electrical actuation. A fluidic die may include a plurality of fluid actuators, which may be referred to as an array of fluid actuators.

While such fluidic systems and dies undoubtedly have advanced the field of precise fluid delivery, some conditions impact their effectiveness. For example, the fluid actuators on a fluidic die are subject to many cycles of heating, drive bubble formation, drive bubble collapse, and fluid replenishment from a fluid reservoir. Over time, and depending on other operating conditions, the fluid actuators may become blocked or otherwise defective. For example, particulate matter, such as dried ink or powder build material, can block the opening. This particulate matter can adversely affect the formation and release of subsequent fluid. Other examples of scenarios that may affect the operation include a fusing of the fluid on the actuator element, surface puddling, and general damage to components within the firing chamber. As the process of depositing fluid on a surface, or moving a fluid through a fluidic die is a precise operation, these blockages can have a deleterious effect on print quality or other operation of the system in which the fluidic die is disposed. If one of these actuators fails, and is continually operating following failure, then it may cause neighboring actuators to fail.

Accordingly, the present specification is directed to determining a state of a particular fluid actuator and/or identifying when a fluid actuator is blocked or otherwise malfunctioning. Following such an identification, appropriate measures such as actuator servicing and actuator replacement can be performed. Specifically, the present specification describes such components as being located on the die.

To perform such identification, a fluidic die of the present specification includes a number of sensor plates, each of which are disposed in a firing chamber of a firing subassembly. A measurement device, which is coupled to multiple sensor plates, forces a current onto a selected sensor plate and after a determined period of time, the measurement device measures the voltage detected on the sensor plate. This detected voltage can be used to determine a state of the conditions within the firing chamber.

However, the evaluation of different firing subassemblies may be affected by the layout of the fluidic die. For example, the firing subassemblies may be aligned in a column along the edge of a fluid feed slot. The selectors that are paired with each firing subassembly, that allow the firing subassemblies to be coupled to the measurement device for evaluation, are disposed near the measurement device and are more closely spaced than the firing subassemblies themselves. Accordingly, this means that the transmission paths fan-out from the selectors to the respective firing subassemblies. Thus, the transmission paths have different lengths. The different length transmission paths result in a parasitic capacitance between a selector and its respective firing subassembly that differs among the different firing subassemblies. This varying capacitance results in varying measurements taken. That is, as described above, a voltage is received at a measurement device which is used to determine a firing subassembly state. However, parasitic capacitance along the transmission path alters the received voltage value. Accordingly different paths with different parasitic capacitances result in the voltage value received at the measurement device varying to different degrees, depending on the firing subassembly being tested. This variation could lead to an incorrect determination of firing subassembly state.

For example, a certain voltage value may map to a particular actuator state. The voltage response of the sensor plate to stimulus from the measurement device may vary based on the parasitic capacitance. The voltage response may be different enough that the voltage value received by the measurement device maps to a different actuator state. The difference in the mapping may result in the fluid actuator being misclassified. In general, a degree of uncertainty or error is introduced into subassembly state determination based on small variations in parasitic capacitance between the different firing subassemblies. This variation in parasitic capacitance is due to different lengths as well as surrounding metal above or below the transmission paths between selectors and respective firing subassemblies.

Accordingly, the present specification describes fluidic die and methods to alleviate these and other issues. Specifically, the present fluidic die includes transmission paths with uniform parasitic capacitance such that any variation of a voltage received by the measurement device is the same for all firing subassemblies on a fluidic die. This may be done by changing the physical properties of some transmission paths. As a specific example, metal may be added to a transmission path, or to metal proximate to the transmission path, with the shortest distance between sensor plate/selector such that its parasitic capacitance tends toward, and matches within a range, the parasitic capacitance of the transmission path with the greatest distance between sensor plate/selector.

Specifically, the present specification describes a fluidic die. The fluidic die includes an array of firing subassemblies grouped into zones. Each firing subassembly includes 1) a firing chamber, 2) a fluid actuator disposed within the firing chamber, and 3) a sensor plate disposed within the firing chamber. The fluidic die also includes a measurement device per zone to determine a state of a selected sensor plate. The fluidic die also includes a selector per firing subassembly to couple the selected sensor plate to the measurement device. Each selector has a transmission path between it and its corresponding sensor plate. In this example, a first transmission path for a particular sensor plate has physical properties such that a parasitic capacitance along the first transmission path corresponds to a parasitic capacitance for a second transmission path of a second sensor plate in the zone, regardless of a difference in transmission path length.

In another example, the fluidic die includes the array of firing subassemblies grouped into zones, each firing subassembly including a firing chamber, fluid actuator, and sensor plate. In this example, the fluidic die includes the measurement device and the selector per firing subassembly. In this example, selectors for the zone are adjacent the measurement device and each firing subassembly has a different length transmission path to its corresponding selector. In this example, a first transmission path has adjusted physical properties such that a parasitic capacitance along the first transmission path corresponds to a parasitic capacitance for a second transmission path in the zone, regardless of a difference in transmission path length. In this example, the first transmission path is a transmission path within the zone with a shortest distance between a respective selector and sensor plate and the second transmission path is a transmission path within the zone with a longest distance between a respective selector and sensor plate.

The present specification also describes a method. According to the method, a parasitic capacitance along a transmission path is determined for each firing subassembly of a group. A transmission path with a longest distance between a respective selector and sensor plate and a transmission path with a shortest distance between a respective selector and sensor plate are then determined. Physical properties of the transmission path with the shortest distance are adjusted such that its parasitic capacitance more closely matches a parasitic capacitance of the transmission path with the longest distance.

In one example, using such a fluidic die 1) makes the parasitic capacitance of the various transmission paths on a fluidic die uniform; 2) provides consistent data on which subsequent voltage-to-state mappings can rely; 3) allows for accurate, repeatable, and consistent actuator evaluation; and 4) capitalizes on available space on the fluidic die.

As used in the present specification and in the appended claims, the term "fluid actuator" refers an ejecting fluid actuator and/or a non-ejecting fluid actuator. For example, an ejecting fluid actuator operates to eject fluid from the fluidic ejection die. A recirculation pump, which is an example of a non-ejecting fluid actuator, moves fluid through the fluid slots, channels, and pathways within the fluidic die.

Accordingly, as used in the present specification and in the appended claims, the term "firing subassembly" refers to an individual component of a fluidic die that ejects/moves fluid.

Further, as used in the present specification and in the appended claims, the term "fluidic die" refers to a component of a fluid system that includes a number of fluid actuators. A fluidic die includes fluidic ejection dies and non-ejecting fluidic dies.

As used in the present specification and in the appended claims, the term "a number of" or similar language is meant to be understood broadly as any positive number including 1 to infinity.

Turning now to the figures, FIG. 1 is a block diagram of a fluidic die (100) with transmission paths (114) with corresponding parasitic capacitance, according to an example of the principles described herein. As described above, the fluidic die (100) is a part of the fluidic system that houses components for ejecting fluid and/or transporting fluid along various pathways. The fluid that is ejected and moved throughout the fluidic die (100) can be of various types including ink, biochemical agents, and/or fusing agents. The fluid is moved and/or ejected via an array of fluid actuators (106). Any number of fluid actuators (106) may be formed on the fluidic die (100).

The fluidic die (100) includes an array of firing subassemblies (102). The firing chambers (104) of the firing subassemblies (102) include a fluid actuator (106) disposed therein, which fluid actuator (106) works to eject fluid from, or move fluid throughout, the fluidic die (100). The fluid chambers (104) and fluid actuators (106) may be of varying types. For example, the firing chamber (104) may be an ejection chamber wherein fluid is expelled from the fluidic die (100) onto a surface for example such as paper or a 3D build bed. In this example, the fluid actuator (106) may be an ejector that ejects fluid through an opening of the firing chamber (104).

In another example, the firing chamber (104) is a channel through which fluid flows. That is, the fluidic die (101) may include an array of microfluidic channels. Each microfluidic channel includes a fluid actuator (106) that is a fluid pump. In this example, the fluid pump, when activated, displaces fluid within the microfluidic channel. While the present specification may make reference to particular types of fluid actuators (106), the fluidic die (100) may include any number and type of fluid actuators (106).

Figure 2:
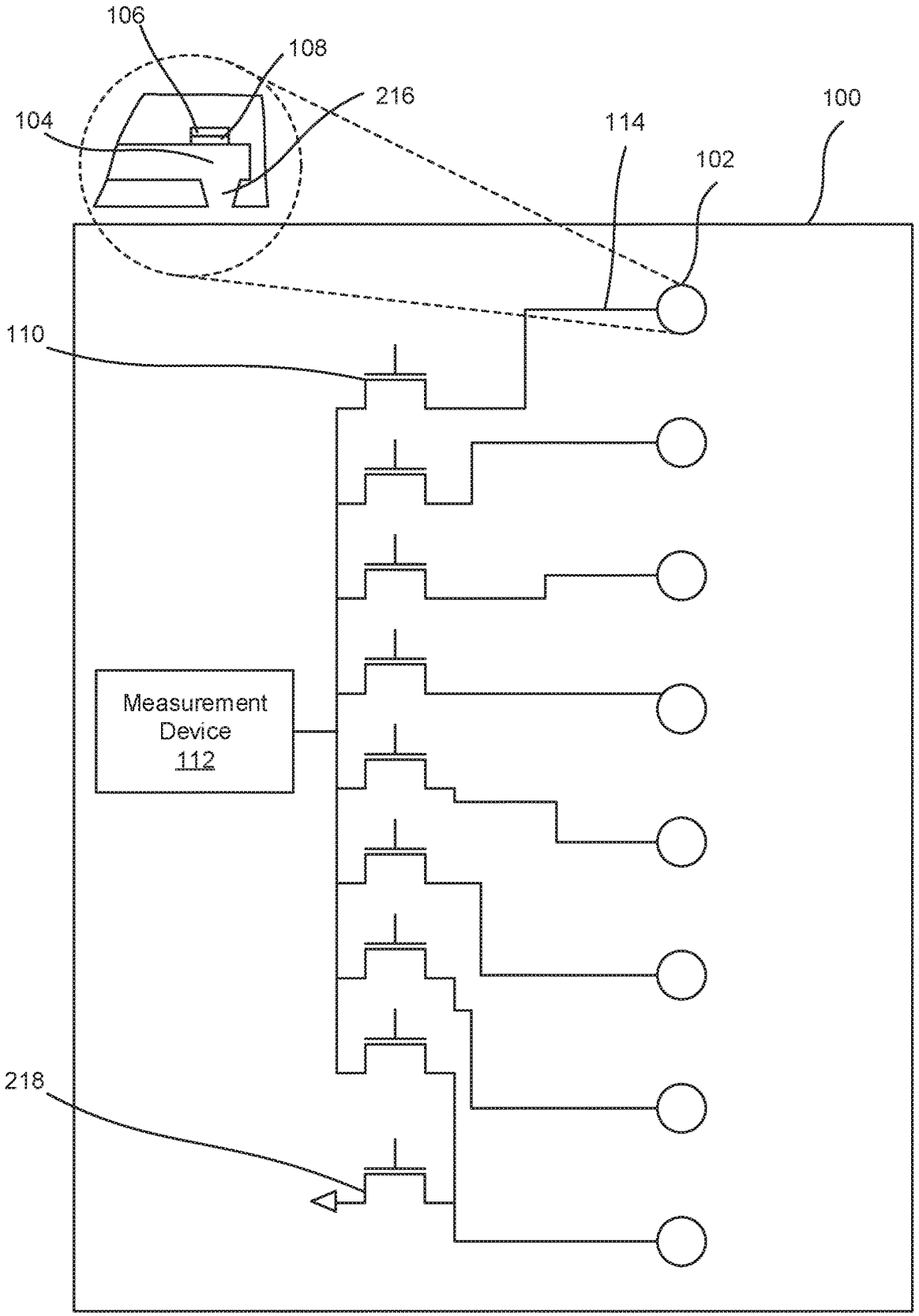
FIG. 2 is a circuit diagram of a fluidic die with transmission paths with corresponding parasitic capacitance, according to an example of the principles described herein.

Each firing subassembly (102) also includes a sensor plate (108). In some examples, as depicted in FIG. 2, the sensor plate (108) is disposed within the firing chamber (104). The sensor plate (108) senses a characteristic of a corresponding fluid actuator (106). For example, the sensor plate (108) may measure an impedance near a fluid actuator (106). In a specific example, the sensor plates (108) are drive bubble detectors that detect the presence, or absence, of fluid in the firing chamber (104) during a firing event of the fluid actuator (106).

In this example, a drive bubble is generated by a fluid actuator (106) to move fluid in, or eject fluid from, the firing chamber (104). Specifically, in thermal inkjet printing, a thermal ejector heats up to vaporize a portion of fluid in a firing chamber (104). As the bubble expands, it forces fluid out of the firing chamber (104). As the bubble collapses, a negative pressure and/or capillary force within the firing chamber (104) draws fluid from the fluid source, such as a fluid feed slot or fluid feed holes, to the fluidic die (100). Sensing the proper formation and collapse of such a drive bubble can be used to evaluate whether a particular fluid actuator (106) is operating as expected. That is, a blockage in the firing chamber (104) will affect the formation of the drive bubble. If a drive bubble has not formed as expected, it can be determined that the nozzle is blocked and/or not working in the intended manner.

The presence of a drive bubble can be detected by measuring impedance values within the firing chamber (104). That is, as the vapor that makes up the drive bubble has a different conductivity than the fluid that otherwise is disposed within the chamber, when a drive bubble exists in the firing chamber (104), a different impedance value will be measured. Accordingly, a drive bubble detection device measures this impedance and outputs a corresponding voltage. As will be described below, this output can be used to determine whether a drive bubble is properly forming and therefore determine whether the corresponding ejector or pump is in a functioning or malfunctioning state.

The firing subassemblies (102) may be grouped into zones. For example, a group of eight firing subassemblies (102) may be formed into one zone. While specific reference is made to eight firing subassemblies (102) being formed into a zone, any number of firing subassemblies (102) may be formed into a zone.

The fluidic die (100) also includes a measurement device (112) per zone. The measurement device (112) evaluates a state of any sensor plate (108) in the zone and generates an output indicative of the sensor plate (108) state. For example, a sensor plate (108) may output multiple values that correspond to impedance measurements within a firing chamber (104) at different points in time. These values can be compared against a threshold. The threshold delineates between a proper bubble formation and a faulty bubble formation.

As a specific example, a voltage difference is calculated between measurements taken at a peak time and a refill time, a voltage difference that is lower than or greater than a threshold may indicate improper bubble formation and collapse. Accordingly, a voltage difference greater than or less than the threshold may indicate proper bubble formation and collapse. While a specific relationship, i.e., low voltage difference indicating improper bubble formation, high voltage difference indicating proper bubble formation, has been described, any desired relationship can be implemented in accordance with the principles described herein.

As multiple firing subassemblies (102) are coupled to a single measurement device (112), each firing subassembly (102) is coupled to a selector (110) that couples a respective sensor plate (108) to the measurement device (112). For example, it may be too complex, costly, and large to include a measurement device (112) per firing subassembly (102). Accordingly, the measurement device (112) is multiplexed to multiple firing subassemblies (102). Accordingly, a select signal is passed to a particular selector (110) which couples the corresponding firing subassembly (102) to the measurement device (112).

The path between a particular sensor plate (108) and its selector (110) may be referred to as a transmission path (114). In some examples, the transmission paths (114) for each selector (110)/sensor plate (108) may be different. For example, the selectors (110) may be small components located adjacent the measurement device (112). In this example, transmission lines fan out from the area of the selectors (110) to the firing subassemblies (102). Such a fan-out results in distances between selectors (110)/sensor plates (108) that are non-uniform. The non-uniformity of theses transmission paths introduces variation into the firing subassembly (102) state determination.

For example, a first sensor plate (108) may have a first voltage response to an applied stimulus. The first voltage response is transmitted as a first voltage value along a corresponding transmission path (114) to the measurement device (112). The measurement device (112) then uses the received first voltage value to determine a state of the first firing subassembly (102).

In this example, a second sensor plate (108) may have a longer transmission path than that associated with the first sensor plate (108), and therefore has a different parasitic capacitance. Accordingly, the second sensor plate (108) may have a response to the stimulus that is different than the first voltage response. This second voltage response is transmitted as a second voltage value to the measurement device (102), which second voltage value is different than the first voltage value. Accordingly, the value that is ultimately received at the measurement device (112) may be a different value than what is received along the first transmission path (114), notwithstanding each sensor plate (108) may be in the same state. The difference in the received values could lead to a different state determination, even though they are actually at the same state, i.e., the same impedance value. In other words, the parasitic capacitance along a transmission path (114) affects the received voltage. Accordingly, it is desirable that the effects are the same across all firing subassemblies (102) within a zone.

Accordingly, in the fluidic die of the present specification, a first transmission path (114) for a particular sensor plate (108) has physical properties such that a parasitic capacitance along the first transmission path (114) corresponds to a parasitic capacitance for a second transmission path of a second sensor plate (108), regardless of a difference in transmission path length. That is, the parasitic capacitance of the adjusted first transmission path and the second transmission path may be within 5% of each other, or may be within 3% or 2% of each other. That is, corresponding parasitic capacitances may refer to transmission paths whose parasitic capacitance is within 5% of each other and in some examples within 3% of each other. In yet another example, corresponding parasitic capacitance may refer to transmission paths (114) with parasitic capacitance within 2% of each other.

For example, metal may be added to the first transmission path (114) such that its parasitic capacitance is more closely matched to another transmission path (114). Doing so ensures a consistent and repeatable state determination. That is, during firing subassembly (102) state determination, there are various sources of variation. However, the fluidic die (100) as described herein alleviates some of that variation by eliminating variation of measurement values as received from a sensor plate (108). Elimination or reduction of this variation allows for more accurate firing subassembly (102) health determination.

FIG. 2 is a circuit diagram of a fluidic die (100) with transmission paths (114) with corresponding parasitic capacitance, according to an example of the principles described herein. For simplicity, only one instance of a particular component is described with a reference number.

As described above, the fluidic die (100) includes an array of firing subassemblies (102). In some examples, the firing subassemblies (102) are formed into columns. For simplicity in FIG. 2, the firing subassemblies (102) are enlarged to show detail and the relative size between different components may not be representative of actual sizes. As described above, each firing subassembly (102) includes various components to eject/move fluid. In the example, depicted in FIG. 2, the firing subassembly (102) is an ejection subassembly that ejects fluid. In this example, the subassembly (102) includes the fluid actuator (106), firing chamber (104), and an opening (216) through which fluid is expelled. As described above, the fluid actuator (106) may be a mechanism for ejecting fluid through the opening (216) of the firing chamber (104). The fluid actuator (106) may include a firing resistor or other thermal device, a piezoelectric element, or other mechanism for ejecting fluid from the firing chamber (104).

For example, the fluid actuator (106) may be a firing resistor. The firing resistor heats up in response to an applied voltage. As the firing resistor heats up, a portion of the fluid in the firing chamber (104) vaporizes to form a bubble. This bubble pushes liquid fluid out the opening (216) and onto the print medium. As the vaporized fluid bubble collapses, a vacuum pressure along with capillary force within the firing chamber (104) draws fluid into the firing chamber (104) from a reservoir, and the process repeats. In this example, the fluidic die (100) may be a thermal inkjet fluidic die (100).

In another example, the fluid actuator (106) may be a piezoelectric device. As a voltage is applied, the piezoelectric device changes shape which generates a pressure pulse in the firing chamber (104) that pushes a fluid out the opening (216) and onto the print medium. In this example, the fluidic die (110) may be a piezoelectric inkjet fluidic die (100).

Structurally the sensor plate (108) may include a single electrically conductive plate, such as a tantalum plate, which can detect an impedance of whatever medium is within the firing chamber (104). Specifically, each sensor plate (108) measures an impedance of the medium within the firing chamber (104), which impedance measurement, as described above, can indicate whether a drive bubble is properly forming in the firing chamber (104). The sensor plate (108) then outputs voltage values indicative of a state, i.e., drive bubble formed or not, of the corresponding fluid actuator (106). This output can be compared against threshold values to determine whether the fluid actuator (106) is malfunctioning or otherwise inoperable.

FIG. 2 also depicts the selectors (110) that are used to couple a particular firing subassembly (102) to the measurement device (110). As depicted in FIG. 2, the selectors (110) may be field-effect transistors (FETs) such as PMOS FETs or NMOS FETs. In this example, a select signal is passed to a gate of a particular selector (110) which generates a closed path between the sensor plate (108) of the firing subassembly (102) and the measurement device (112) such that sensor plate (108) state may be determined.

As noted above, due to size restrictions, the selectors (110) may be placed near the measurement device (112). Accordingly, the distance between the selectors (110) and their corresponding sensor plate (108) may differ. The difference in transmission paths means that voltages passed to the measurement device (112) may differ due to differences in parasitic capacitance. That is, to perform a fluid actuator (106) measurement, a single selector (110) is enabled. As a result, the measurement device (112) is coupled to just one sensor plate (108). The measurement device (112) then forces a current onto the selected sensor plate (108) and after a predetermined amount of time, the measurement device (112) measures the voltage. In this example, the voltage received at the measurement device (112) is a function of the impedance in the firing chamber (104) as well as 1) a parasitic capacitance on the transmission path (114) between a selector (110) and a sensor plate (108) and 2) a parasitic capacitance on the path between the selector (110) and the measurement device (112).

In any measurement operation, it is desirable to isolate the measured voltage to have a reliable mapping to the measured impedance. Accordingly, it is desirable to remove any variation resulting from the parasitic capacitances. The parasitic capacitance between the selectors (110) and the measurement device (112) is shared by all selectors (110) and is thus the same with no variation between them. However, the parasitic capacitance between each selector (110) and its associated sensor plate (108) may be different as described above. Accordingly, those transmission paths (114) that have lower parasitic capacitance are adjusted to have more, and thus to have closer parasitic capacitance to transmission paths (114) with inherently more parasitic capacitance.

In addition to the components depicted herein, in some examples, each transmission path (114) may include a pull down switch to 1) reset the sensor plate (108) to a known voltage before measurement, 2) maintain the sensor plate (108) at a safe voltage when normal firing, and 3) to conduct electrical leakage tests between neighboring sensor plates (108). For simplicity a single instance of a pull-down switch (218) is depicted in FIG. 2.

Figure 3:
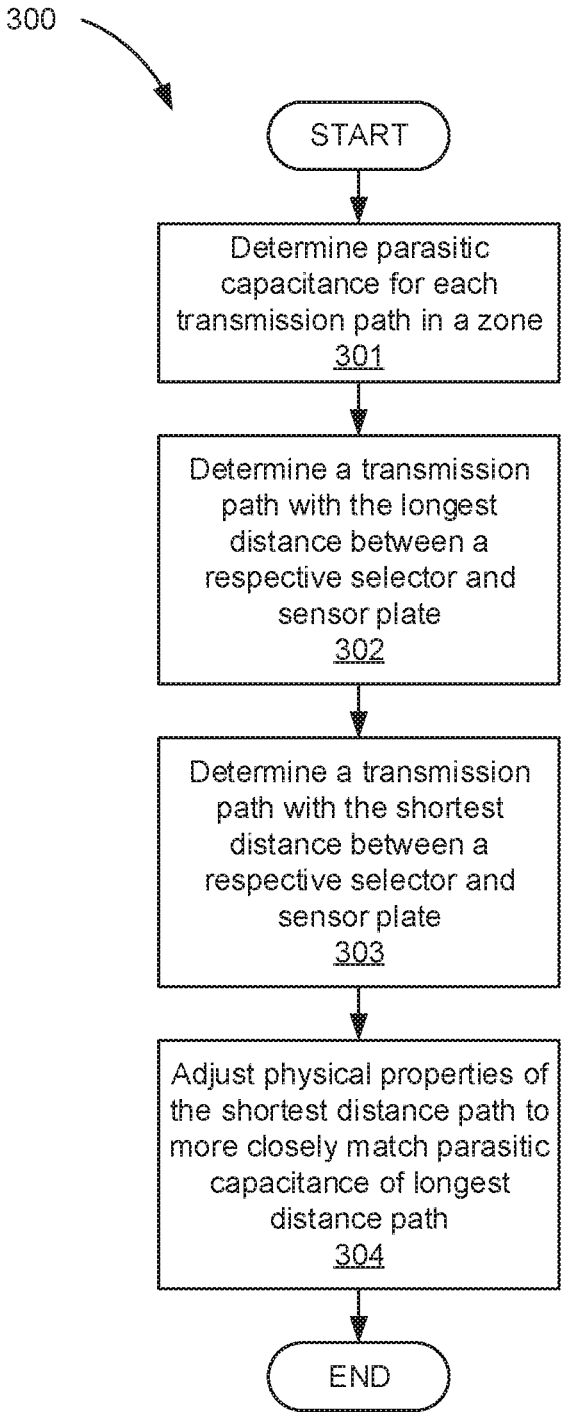
FIG. 3 is a flow chart of a method for corresponding parasitic capacitance on a fluidic die, according to an example of the principles described herein.

FIG. 3 is a flow chart of a method (300) for corresponding parasitic capacitance on a fluidic die (FIG. 1, 100), according to an example of the principles described herein. As described above, having transmission paths (FIG. 1, 114) between selectors (FIG. 1, 110) and sensor plates (FIG. 1, 108) that are different can be detrimental to fluid actuator (FIG. 1, 106) evaluation. For example, different length and shape transmission paths (FIG. 1, 114) have different parasitic capacitance. For example, the longest transmission path (FIG. 1, 114) in a zone of 16 firing subassemblies (FIG. 1, 102) may have a parasitic capacitance that can be 10 times greater than the parasitic capacitance of the shortest transmission path (FIG. 1, 114). Such a difference in capacitance can result in different state determinations, regardless of the actual state of the corresponding fluid actuators (FIG. 1, 106). For example, both firing subassemblies (FIG. 1, 102) may be healthy, but the different parasitic capacitances could lead to an incorrect determination of firing subassembly (FIG. 1, 102) functionality. To address the capacitance variation, the transmission paths (FIG. 1, 114) can be designed such that parasitic capacitance are more equal.

Specifically, for each firing subassembly (FIG. 1, 102) of a zone, a parasitic capacitance is determined (block 301) for the transmission path (FIG. 1, 114) between the sensor plate (FIG. 1, 108) of that firing subassembly (FIG. 1, 102) and the associated selector (FIG. 1, 110). Each transmission path (FIG. 1, 114) may be unique in that it has different lengths, widths etc. This is due in part due to the fanning out from the selectors (FIG. 1, 110) to the corresponding sensor plates (FIG. 1, 108) as depicted in FIG. 2. Accordingly, it is then determined (block 302) which transmission path has a longest distance between selector (FIG. 1, 110) and sensor plate (FIG. 1, 108) and it is determined (block 303) which transmission path (FIG. 1, 114) has the shortest distance between selector (FIG. 1, 110) and sensor plate (FIG. 1, 108). Physical properties of the transmission path (FIG. 1, 114) with the shortest distance between selector (FIG. 1, 110) and sensor plate (FIG. 1, 108) are then adjusted (block 304) such that its parasitic capacitance more closely matches a parasitic capacitance of the transmission path with the longest distance between selector (FIG. 1, 110) and sensor plate (FIG. 1, 108). For example, the transmission path (FIG. 1, 114) with the shortest distance between selector (FIG. 1, 110) and sensor plate (FIG. 1, 108) could be altered such that its parasitic capacitance is within 5% of the transmission path (FIG. 1, 114) with the longest distance between selector (FIG. 1, 110) and sensor plate (FIG. 1, 108). Such adjustments could also be made such that the parasitic capacitances correspond within 3% of each other, or correspond within 2% of each other. By adjusting (block 304) the shortest distance path, the range of capacitive variation across the zone is thereby reduced, thus reducing the variation in state outputs.

Adjusting (block 304) the lowest parasitic capacitance value to be closer to the highest parasitic capacitance value may be done in a number of ways. For example, it may include adding metal to the transmission path (FIG. 1, 114) with the shortest distance between selector (FIG. 1, 110) and sensor plate (FIG. 1, 108). Capacitance of an object is a function of its geometry. Accordingly adding metal to its geometry increases the capacitance. Metal may be added in any number of ways. For example, the length of the transmission path (FIG. 1, 114) with the shortest distance between selector (FIG. 1, 110) and sensor plate (FIG. 1, 108) could be adjusted. More specifically, this transmission path (FIG. 1, 114) may be lengthened. This may be done by winding the wire in a serpentine fashion between the selector (FIG. 1, 110) and the sensor plate (FIG. 1, 108).

In another example, a width of the transmission path (FIG. 1, 114) may be adjusted. More specifically, the transmission path (FIG. 1, 114) with shortest distance between selector (FIG. 1, 110) and sensor plate (FIG. 1, 108) may have its surface area enlarged at certain portions to increase the width, and thereby to increase the capacitance. In essence, these adjustments (block 304) add more material to the transmission path (FIG. 1, 114). The increased material shortens the range between the greatest and least parasitic capacitance on the fluidic die (FIG. 1, 100).

In yet another example, adjusting (block 304) the parasitic capacitance of the transmission path (FIG. 1, 114) with the shortest distance between selector (FIG. 1, 110) and sensor plate (FIG. 1, 108) may include adjusting a number of layers above or below the transmission path (FIG. 1, 114). For example, the transmission path (FIG. 1, 114) may be on one layer, and a via may couple the transmission path (FIG. 1, 114) to a layer where the firing subassembly (FIG. 1, 102) is disposed. Increasing or decreasing the number of layers in a particular region may have an effect on the parasitic capacitance. In some examples, the adjustment (block 304) of the physical properties of the transmission path (FIG. 1, 114) to correspond a parasitic capacitance of the transmission path (FIG. 1, 114) with the highest parasitic capacitance may be repeated for all the firing subassemblies (FIG. 1, 102) in the zone. That is, an iterative process may be used on all firing subassemblies (FIG. 1, 102) in a zone to make the respective parasitic capacitances more uniform.

In some examples, this method (300) may be performed on a group subset level. That is, within a group of firing subassemblies (FIG. 1, 102) there may be subsets of different types. For example, a fluidic die (FIG. 1, 100) may include high drop weight firing subassemblies (FIG. 1, 102) and low drop weight firing subassemblies (FIG. 1, 102). The high drop weight firing subassemblies (FIG. 1, 102) may be grouped together as are the low drop weight firing subassemblies (FIG. 1, 102). Within each group it may be determined (block 302) which firing subassembly (FIG. 1, 102) has the transmission path (FIG. 1, 114) with the longest and shortest distance between selector (FIG. 1, 110) and sensor plate (FIG. 1, 108). In each group, that transmission path (FIG. 1, 114) with the shortest distance between selector (FIG. 1, 110) and sensor plate (FIG. 1, 108) is then adjusted (block 304) such that its capacitance more closely matches the respective transmission path (FIG. 1, 114) within the subset that has the longest distance between selector (FIG. 1, 110) and sensor plate (FIG. 1, 108). Doing so may be beneficial as it may be unnecessary to have corresponding parasitic capacitance across firing subassembly (FIG. 1, 112) types.

For example, different measurement settings are used for different drop weights, or actuator types, etc. Consequently, the parasitic capacitance matching need only be done between firing subassemblies (FIG. 1, 102) of the same type. As a specific example, a 16 subassembly (FIG. 1, 102) zone may include 8 high drop weight subassemblies and 8 low drop weight subassemblies (FIG. 1, 102). A maximum and minimum capacitance for the high drop weight subassemblies (FIG. 1, 102) may be 30 femtoFarads and 10 femtoFarads respectively. For the low drop weight subassemblies (FIG. 1, 102), the maximum and minimum may be 22 femtoFarads and 7 femtoFarads, respectively. In this example, all the high drop weight subassemblies (FIG. 1, 102) transmission paths (FIG. 1, 114) may be adjusted such that their parasitic capacitance is closer to 30 femtoFarads and all the low drop weight subassemblies (FIG. 1, 102) transmission paths (FIG. 1, 114) may be adjusted such that their parasitic capacitance is closer to 22 femtoFarads. Adjusting the low drop weight subassemblies (FIGS. 1, 102) to 30 femtoFarads, i.e., regardless of type, may impact performance, for example because the low drop weight subassemblies (FIG. 1, 102) implement a smaller resistor.

As another example, a fluidic die (FIG. 1, 100) may include ejecting firing assemblies (FIG. 1, 102) and non-ejecting firing subassemblies (FIG. 1, 102), e.g., pumps. Within each group it may be determined (block 302) which firing subassembly (FIG. 1, 102) has the transmission path (FIG. 1, 114) with the shortest distance between selector (FIG. 1, 110) and sensor plate (FIG. 1, 108) and which has the longest distance between selector (FIG. 1, 110) and sensor plate (FIG. 1, 108). In each group, that transmission path (FIG. 1, 114) with the shortest is then adjusted (block 304) such that its capacitance more closely matches the respective transmission path (FIG. 1, 114) within the subset that has the longest. Doing so may be beneficial as it may be unnecessary to have parasitic capacitance correspond across firing subassembly (FIG. 1, 102) types and in some cases could affect the quality of one or more of the group subsets.

Figure 4:
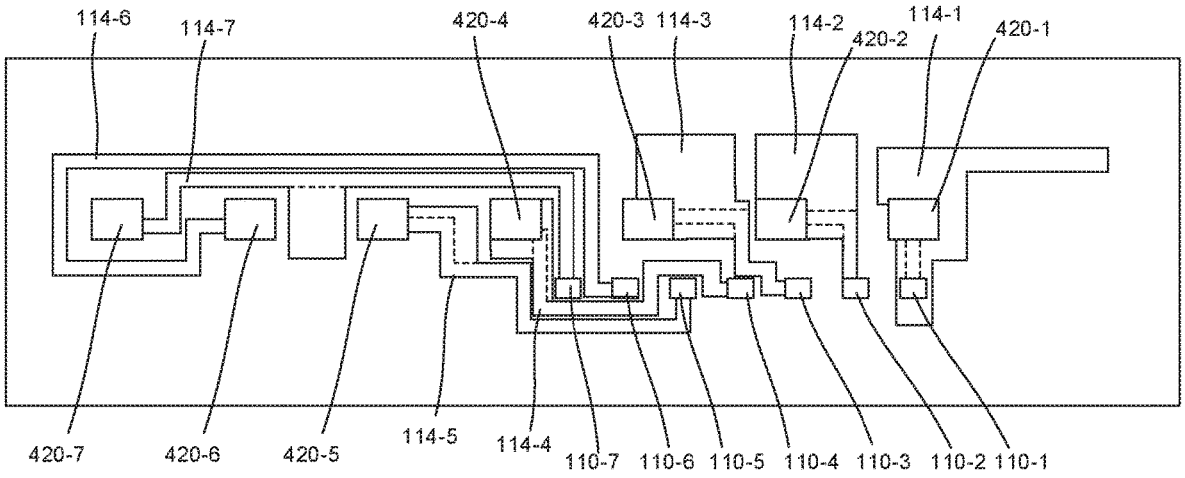
FIG. 4 is a diagram of a fluidic die with transmission paths with corresponding parasitic capacitance, according to an example of the principles described herein.

FIG. 4 is a functional diagram of a fluidic die (FIG. 1, 100) with transmission paths (114) with corresponding parasitic capacitance, according to an example of the principles described herein. Specifically, FIG. 4 depicts paths between sensor nodes (420) and respective selectors (110). In this example, a sensor node (420) is a hardware component that is coupled to the sensor plate (FIG. 1, 108) within a firing subassembly (FIG. 1, 102) which may be on a different layer of the fluidic die (FIG. 1, 100). FIG. 4 also depicts the selectors (110) which may be coupled to a measurement device (FIG. 1, 112) which for simplicity is not depicted herein. Note that as described above, each selector (110) may be coupled in parallel to the measurement device (FIG. 1, 112) such that any parasitic capacitance between selectors (110) and the measurement device (FIG. 1, 112) is shared, and therefore uniform across each selector (110). As it is uniform/shared by all selectors (110) it is not a source of variation along the transmission path between the firing subassemblies (FIG. 1, 102) and the measurement device (FIG. 1, 112).

FIG. 4 also clearly depicts a fanning out from each selector (110) to a respective sensor node (420) which is coupled to a respective sensor plate (FIG. 1, 108). Such a fanning out results in transmission paths (shown in dashed lines) that are not the same length. Accordingly, transmission paths (114) are adjusted such that their capacitance may be more equally matched. As described above, this adjustment may be made to any number of the transmission paths except the one with the longest transmission path. That is, a distance between the first selector (110-1) to the first sensor node (420-1) may be the shortest and may have a least amount of parasitic capacitance within the zone and a distance between the sixth selector (110-6) to the sixth sensor node (420-6) may be the longest and may have the greatest amount of parasitic capacitance. Accordingly, metal may be added to at least the first transmission path (114-1) to generate a transmission path with parasitic capacitance that corresponds, the parasitic capacitance of the sixth transmission path (114-6). This may be done for each transmission path (114). That is, additional transmission paths for respective sensor plates (FIG. 1, 108) may have physical properties such that the parasitic capacitance along the respective transmission paths (114) correspond the parasitic capacitance for the longest transmission path (114), which in this case is the sixth transmission path (114-6). The original transmission path for each selector (110) is depicted in ghost, and the transmission path (114) for each selector (110) with adjusted physical properties to more closely align all parasitic capacitances is shown in solid line. In summary, the present fluidic die (100) implements transmission paths (114) that regardless of the path length, have the same, or nearly the same, capacitance due to the physical properties being adjusted. Note that while FIG. 4 depicts seven instances of various elements, a fluidic die (FIG. 1, 100) may include any number of these elements.

Figure 5:
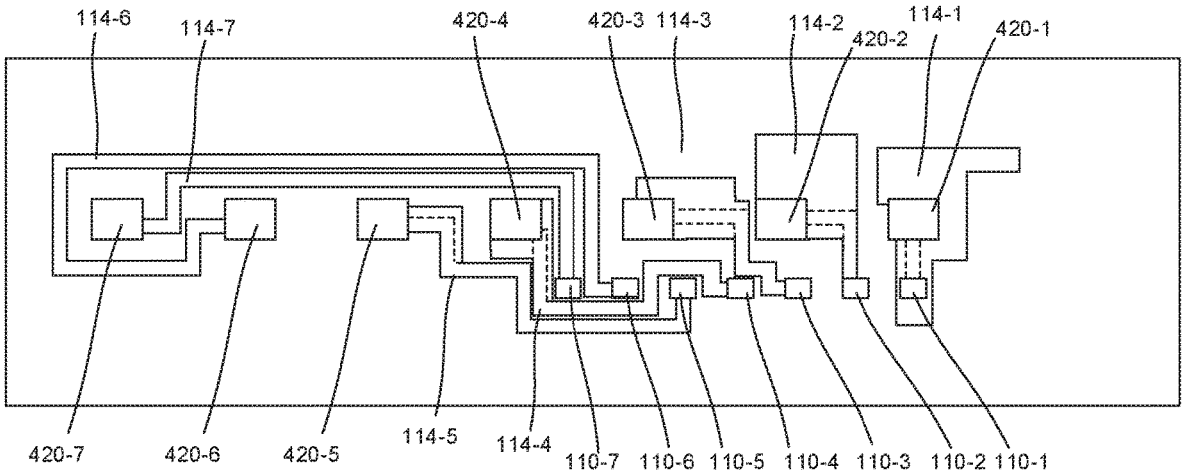
FIG. 5 is a diagram of a fluidic die with transmission paths with corresponding parasitic capacitance, according to another example of the principles described herein.

FIG. 5 is a functional diagram of a fluidic die (FIG. 1, 100) with transmission paths (FIG. 1, 114) with corresponding parasitic capacitance, according to another example of the principles described herein. Specifically, FIG. 5 depicts an example where each zone includes multiple subsets of firing subassemblies (FIG. 1, 102). For example, a first, third, fifth, and seventh sensor node (420-1, 420-3, 420-5, 420-7) may correspond to a first subset with one type of fluid actuator (FIG. 1, 106) and the second, fourth, and sixth sensor nodes (420-2, 420-4, 420-6) may correspond to a second subset with a second type of fluid actuator (FIG. 1, 106). In this example, at least one transmission path (114) within each subset has physical properties such that its parasitic capacitance corresponds to a parasitic capacitance for another transmission path (114) within the subset, regardless of path length.

For example, in the first subset, the first selector (110-1) may have the shortest distance to its corresponding sensor node (420) and may have the least amount of original parasitic capacitance and the seventh selector (110-7) may have the longest distance to tis corresponding sensor node (420) and may have the greatest amount of original parasitic capacitance. In this example, the first transmission path (114-1) is altered so as to more closely align with the seventh transmission path (114-7). The other transmission paths in this group, i.e., the third transmission path (114-3) and the fifth transmission path (114-5) may similarly be adjusted such that their parasitic capacitance corresponds to that of the seventh transmission path (114-7).

Similarly, in the second subset, the second selector (110-2) may have the shortest distance to its corresponding sensor node (420) and may have the least amount of original parasitic capacitance and the sixth selector (110-6) may have the longest distance to its corresponding sensor node (420) and may have the greatest amount of original parasitic capacitance. In this example, the second transmission path (114-2) is altered so as to more closely align with the sixth transmission path (114-6). The other transmission path in this group, i.e., the fourth transmission path (114-4) may similarly be adjusted such that their parasitic capacitance corresponds to that of the sixth transmission path (114-6).

Note that the adjustments to the first, third and fifth transmission paths (114-1, 114-3, 114-5) may be different than depicted in FIG. 4, this is because the longest distance is no longer the sixth transmission path (114-6), but the seventh (114-7) which may have a lower capacitance than the sixth transmission path (114-6), thus any adjustment to correspond to it may not be as extreme.

The types of fluid actuator (FIG. 1, 106) that may be grouped into different subsets may include high drop weight fluid actuators (FIG. 1, 106), low drop weight fluid actuators (FIG. 1, 106) and non-ejecting fluid actuators (FIG. 1, 106).

Figure 6:
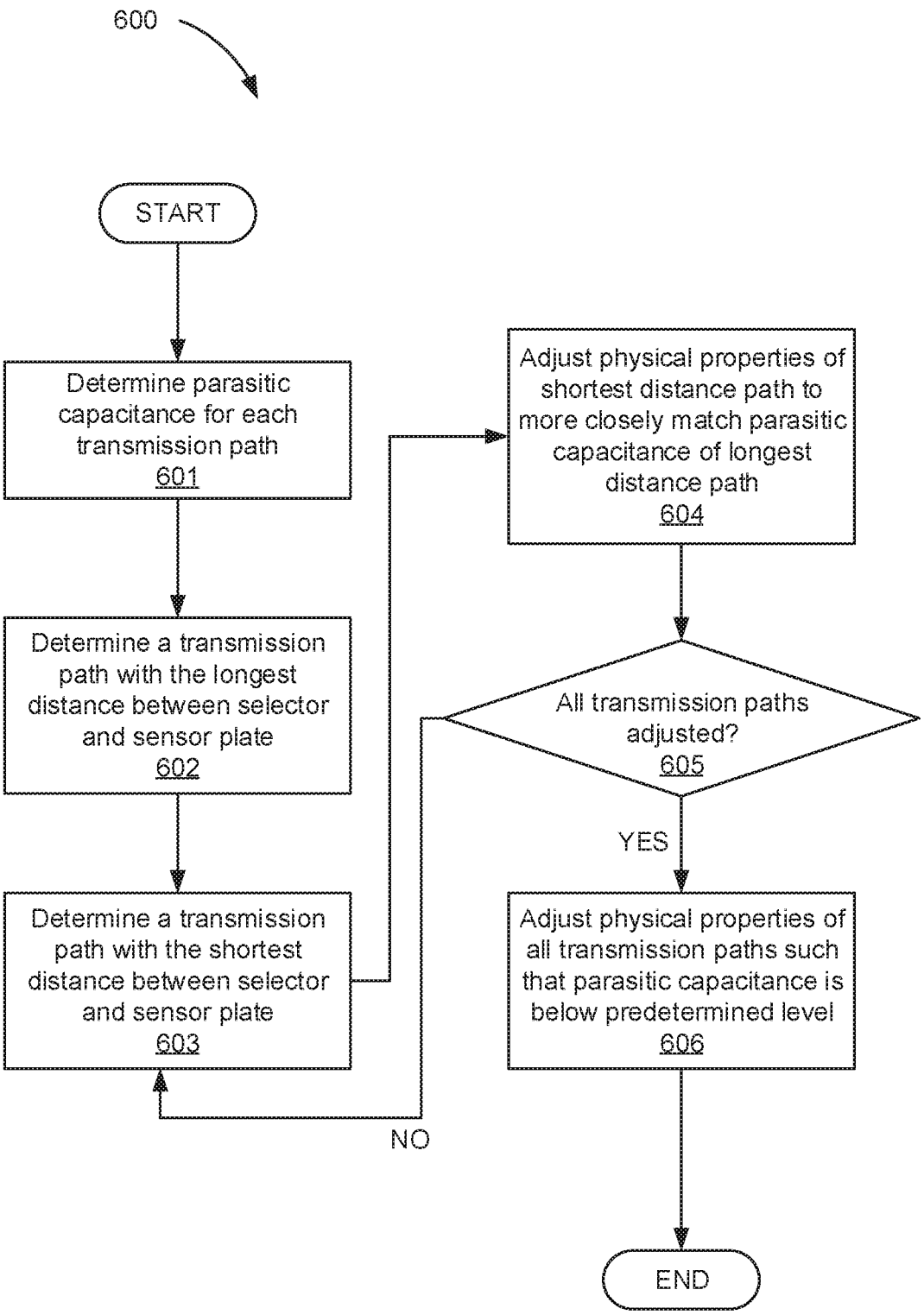
FIG. 6 is a flow chart of a method for corresponding parasitic capacitance on a fluidic die, according to another example of the principles described herein.

FIG. 6 is a flow chart of a method (600) for corresponding parasitic capacitance on a fluidic die (FIG. 1, 100), according to another example of the principles described herein. According to the method, parasitic capacitance is determined (block 601) for each firing subassembly (FIG. 1, 102), transmission paths with the longest and shortest distance between respective selectors (FIG. 1, 110) and sensor plates (FIG. 1, 108) are determined (block 602, block 603), and physical properties are adjusted (block 604) for at least one transmission path such that the range of different parasitic capacitances is reduced. These operations may be performed as described above in connection with FIG. 2. In some examples, this process may be iterative. For example, after adjusting (block 604) physical properties of the lowest and/or shortest parasitic capacitance path, it may be determined (block 605) if all other transmission paths (FIG. 1, 114) have been adjusted. If not, (block 605, determination NO), it could again be determined (block 603) which transmission path (FIG. 1, 114) has the lowest parasitic capacitance and/or is the shortest and the physical properties of that transmission path (FIG. 1, 114) adjusted (block 604). If each transmission path (FIG. 1, 114) has been adjusted (block 605, determination YES), then the method (600) continues.

In addition to adjusting the transmission paths (FIG. 1, 114) such that the parasitic capacitances correspond, the physical properties may be further adjusted (block 606) such that all transmission paths (FIG. 1, 114) within the zone have less than a predetermined amount of parasitic capacitance. That is, the current method (600) may reduce 1) the range of parasitic capacitance and 2) the maximum parasitic value within the zone. In some examples, the target amount of parasitic capacitance may be determined based on the firing subassembly type (FIG. 1, 102).

In one example, using such a fluidic die 1) makes the parasitic capacitance of the various transmission paths on a fluidic die uniform; 2) provides consistent data on which subsequent voltage-to-state mappings can rely; 3) allows for accurate, repeatable, and consistent actuator evaluation; and 4) capitalizes on available space on the fluidic die.

What is claimed is:

1. A fluidic die, comprising:
an array of firing subassemblies grouped into zones, each firing subassembly comprising:
a firing chamber;
a fluid actuator disposed within the firing chamber; and
a sensor plate disposed within the firing chamber;
a measurement device per zone to determine a state of a selected sensor plate; and
a selector per firing subassembly to couple the selected sensor plate to the measurement device;
a transmission path between each selector and its corresponding sensor plate, wherein:
a first transmission path has adjusted physical properties such that a parasitic capacitance along the first transmission path corresponds to a parasitic capacitance for a second transmission path, regardless of a distance between a respective sensor plate and selector.

2. The fluidic die of claim 1, wherein:
the first transmission path is a transmission path within the zone with a shortest distance between a respective selector and sensor plate; and
the second transmission path is a transmission path within the zone with a longest distance between a respective selector and sensor plate.

3. The fluidic die of claim 1, wherein additional transmission paths for respective sensor plates have adjusted physical properties such that parasitic capacitances along the additional transmission paths correspond to the parasitic capacitance for the second transmission path of the second sensor plate in the zone.

4. The fluidic die of claim 1, wherein:
each zone comprises multiple subsets of firing subassemblies; and
each subset comprises a different type of fluid actuator.

5. The fluidic die of claim 4, wherein at least one transmission path within each subset has adjusted physical properties such that a parasitic capacitance along the at least one transmission path corresponds to a parasitic capacitance for another transmission path in the subset.

6. The fluidic die of claim 4, wherein a type of fluid actuator is selected from the group consisting of:
a high drop weight fluid actuator;
a low drop weight fluid actuator; and
a non-ejecting fluid actuator.

7. The fluidic die of claim 4, wherein each firing subassembly within a subset has a transmission path with an adjusted parasitic capacitance less than a predetermined amount for that subset.

8. A fluidic die, comprising:
an array of firing subassemblies grouped into zones, each firing subassembly comprising:
a firing chamber;
a fluid actuator disposed within the firing chamber; and
a sensor plate disposed within the firing chamber;
a measurement device per zone to determine a state of a selected sensor plate; and
a selector per firing subassembly to couple the selected sensor plate to the measurement device, wherein:
selectors for the zone are adjacent the measurement device; and
each firing subassembly has a different length transmission path to its corresponding selector; and
a first transmission path has adjusted physical properties such that a parasitic capacitance along the first transmission path corresponds to a parasitic capacitance for a second transmission path in the zone, regardless of a difference in transmission path length, wherein:
the first transmission path is a transmission path within the zone with a shortest distance between a respective selector and sensor plate; and
the second transmission path is a transmission path within the zone with a longest distance between a respective selector and sensor plate.

9. The fluidic die of claim 8, wherein the array of firing subassemblies are formed into a column.

10. A method, comprising:

determining, for each firing subassembly of a group, a parasitic capacitance along a transmission path between a sensor plate of the firing subassembly and its associated selector;

determining a transmission path with a longest distance between a respective selector and sensor plate;

determining a transmission path with a shortest distance between a respective selector and sensor plate;

adjusting physical properties of the transmission path with the shortest distance such that its parasitic capacitance corresponds to a parasitic capacitance of the transmission path with the longest distance.

11. The method of claim 10, wherein adjusting physical properties of the transmission path with the shortest distance comprises adding metal to the transmission path with the lowest amount of parasitic capacitance.

12. The method of claim 10, wherein adjusting physical properties of the transmission path with the shortest distance comprises at least one of:

adjusting a length of the transmission path with the lowest amount of parasitic capacitance;

adjusting a width of the transmission path with the lowest amount of parasitic capacitance; and adjusting a number of layers above or below the transmission path with the lowest amount of parasitic capacitance.

13. The method of claim 10, further comprising adjusting all transmission paths within the group to have less than a predetermined amount of parasitic capacitance.

14. The method of claim 13, wherein the predetermined amount is selected based on a firing subassembly type.

15. The method of claim 13, wherein, determining a transmission path with a longest distance, determining a transmission path with a shortest distance, and adjusting physical properties of the transmission path with the shortest distance such that its parasitic capacitance corresponds to the parasitic capacitance of the transmission path with the longest distance is done on a group subset level.

* * * * *